US006581795B1

(12) United States Patent
Schülein et al.

(10) Patent No.: US 6,581,795 B1
(45) Date of Patent: Jun. 24, 2003

(54) CONTAINER HAVING HANDLES ON BOTH TOP AND BOTTOM THEREOF

(75) Inventors: Rolf Günter Schülein, Singhofen (DE); Frank Bruchschmidt, Dausenau (DE)

(73) Assignee: Leifheit AG, Nassau/Lahn (DE)

( * ) Notice: Subject to any disclaimer, the term of this patent is extended or adjusted under 35 U.S.C. 154(b) by 0 days.

(21) Appl. No.: 09/589,724

(22) Filed: Jun. 8, 2000

(30) Foreign Application Priority Data

Jun. 10, 1999 (DE) ..... 199 26 477

(51) Int. Cl.[7] ..... B65D 25/28

(52) U.S. Cl. ..... 220/212.5; 99/467; 62/457.6; 126/275 R; 220/912; 220/592.01; 220/523; 220/770; 220/771; 220/755; 220/324

(58) Field of Search ..... 220/212.5, 324, 220/755, 770, 771, 592.01, 912, 504, 523, 527, 526, 524, 4.21; 99/467, 422; 126/275 R; 62/457.6

(56) References Cited

U.S. PATENT DOCUMENTS

| | | | | | |
|---|---|---|---|---|---|
| 797,314 | A | * | 1/1905 | Owens | 126/378.1 |
| 1,112,709 | A | * | 10/1914 | Loehler | 220/212.5 |
| 2,088,848 | A | * | 8/1937 | Fay | 220/212.5 |
| 2,215,274 | A | | 9/1940 | Peterson | |
| D133,936 | S | * | 9/1942 | Barnsteiner | 220/212.5 |
| 2,627,991 | A | | 2/1953 | Maersch | |
| 2,742,850 | A | * | 4/1956 | La Fond | |
| 2,765,831 | A | * | 10/1956 | Tupper | |
| 2,914,104 | A | * | 11/1959 | Jocelyn | 220/769 X |
| 3,035,568 | A | * | 5/1962 | Dama et al. | |
| 3,278,074 | A | * | 10/1966 | Yamazaki | 220/212.5 |
| 3,710,589 | A | * | 1/1973 | Brown et al. | 62/457.2 |
| 3,790,061 | A | | 2/1974 | Pignato | |
| 4,027,778 | A | * | 6/1977 | Tupper | |
| 4,225,052 | A | * | 9/1980 | Tector et al. | 220/212.5 |
| 4,304,106 | A | * | 12/1981 | Donnelly | 62/457.6 |
| 4,360,119 | A | * | 11/1982 | Olivo | |
| 4,375,862 | A | * | 3/1983 | Kurinsky et al. | |
| 4,867,303 | A | * | 9/1989 | Beckerman et al. | |
| 4,873,100 | A | * | 10/1989 | Dirksing et al. | |
| 5,125,391 | A | * | 6/1992 | Srivastava et al. | |
| 5,238,134 | A | * | 8/1993 | Knapp | |
| 5,293,813 | A | * | 3/1994 | Schultz | |
| 5,307,647 | A | * | 5/1994 | McClure | 62/457.6 X |
| 5,365,038 | A | | 11/1994 | Mitsugu | |
| 5,520,103 | A | * | 5/1996 | Zielinski et al. | 126/246 |
| 5,611,320 | A | * | 3/1997 | McDermott | |
| 5,641,065 | A | * | 6/1997 | Owens et al. | 220/324 |
| 5,701,757 | A | * | 12/1997 | Heverly | 62/457.6 X |

FOREIGN PATENT DOCUMENTS

| | | |
|---|---|---|
| DE | 29 25 499 | 1/1981 |
| EP | 153 975 | 9/1985 |

* cited by examiner

*Primary Examiner*—Robin Hylton
(74) *Attorney, Agent, or Firm*—Frishauf, Holtz, Goodman & Chick, P.C.

(57) ABSTRACT

A container for holding foods comprises a base member (1); a cover member (3) which is connected to the base member (1) by releasable locking engagement; a first recessed carrying handle (20) provided on a lower side of the base member (1); and a second recessed carrying handle (11) provided on an upper side of the cover member (3). To achieve a substantially flat support surface for both the base member (1) and the cover member (3), the first and second carrying handles (20, 11) are integrated with and recessed into the contour of the base member (1) and of the cover member (3), respectively, such that each of the base member (1) and the cover member (3) have substantially flat surface portions so that the container will rest stably on a flat support surface such as a table in both the upright and inverted positions of the container.

12 Claims, 3 Drawing Sheets

CONTAINER HAVING HANDLES ON BOTH TOP AND BOTTOM THEREOF

FIELD OF THE INVENTION

This invention relates to a container for holding foods, and more particularly, to such containers having integrated handles on both the top and bottom sides thereof.

BACKGROUND OF THE INVENTION

Such containers, often called cake carriers, have many uses in the household. They are not only used for storing, holding or transporting cakes and pies, but are also used for food storage in general, to protect against flies and other pests, to prevent the food from drying out, and to store foods hygienically. In order to hold a cake or a pie, a relatively large container is required, which takes up valuable space in the kitchen or in storage areas. Such containers are used relatively infrequently.

It is the object of the present invention to provide such a relatively large container for holding foods which is easy to manipulate and has a wide range of uses, without increasing production costs.

SUMMARY OF THE INVENTION

According to the present invention, a container for holding foods comprises a base member (1); a cover member (3) which is removably coupled to the base member (1) by a releasable locking engagement device; a first carrying handle (20) provided on a lower side of the base member (1); and a second carrying handle (11) provided on an upper side of the cover member (3). To achieve a substantially flat support surface for both the base member (1) and the cover member (3), the first and second carrying handles (20, 11) are integrated with and recessed into the contour of the base member (1) and of the cover member (3), respectively.

Putting carrying handles on both the top and bottom of the container makes it possible to use the plate or base portion of the container for carrying pies, cakes and the like and to use the hood or cover portion for containing salads and the like, and to carry the container from either handle, depending upon the contents of the container.

The versatility of the container may be further enhanced by providing chilling or heating elements in or under the base portion of the container.

The shaping of the cover enhances its utility still further.

In a preferred embodiment, an outer groove (12) formed between a substantially central recess (10) and a side wall (13) of the hood or cover member (3) makes it especially simple to mix foods, especially salads, with dressings or sauces.

BRIEF DESCRIPTION OF THE DRAWINGS

An exemplary embodiment of the invention is described in further detail below in conjunction with the drawings, in which.

DETAILED DESCRIPTION

Figures 1, 4:
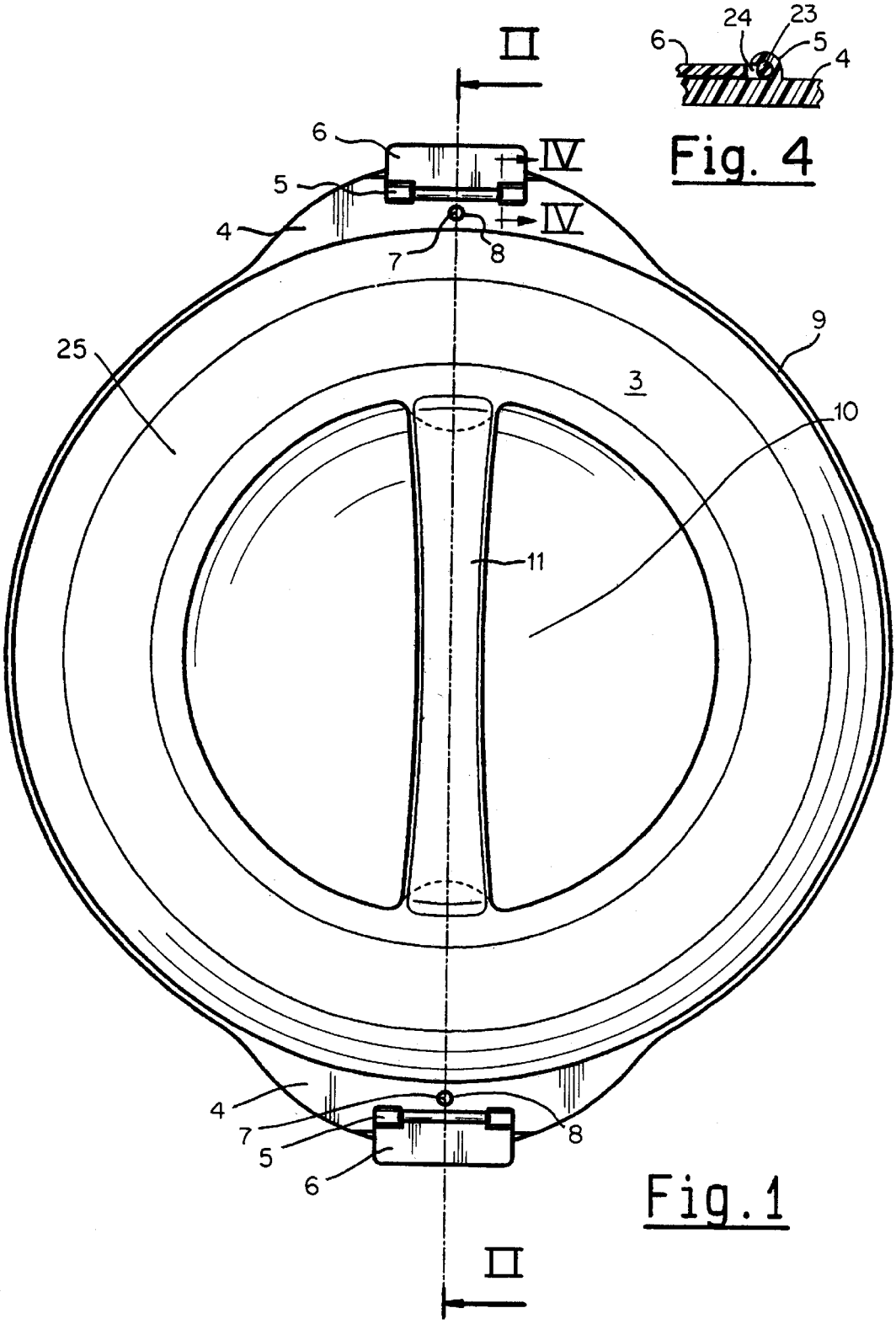
FIG. 1 shows a top view of a container of the present invention.
FIG. 4 is a fragmentary sectional view showing the mounting of the pivotable locking members 6.

The container of the present invention comprises a plate or base member 1 having two grip tabs 2 extending from a supporting surface 22 for supporting food or other contents, and a hood or cover member 3, which is also provided with grip tabs 4. Respective grip tabs 2 and 4 are in registration with each other, as shown in the drawings. Via pivot or hinge joints 5, locking members 6 of generally U-shaped cross section (see FIG. 2) are secured to the grip tabs 4 and connect the grip tabs 2 to the grip tabs 4 by releasable locking engagement with the grip tabs 2 (see FIG. 2). On each of the grip tabs 2, a projection 7 is provided, which engages in a bore or opening 8 in the respective grip tabs 4, in order to fix the position of the cover member 3 relative to the base member 1. The locking members 6 pivot in the direction of arrows A in FIG. 2 to release the cover member 3 from the base member 1. Downwardly inclined finger gripping portions 6a are provided to facilitate the releasing operation. FIG. 4 shows how the locking members 6 have shafts 23 extending therefrom which are pivotably mounted in joint members 5. As shown in FIG. 4, joint members 5 are in the form of an inverted "J" and the shafts 23 at each end of locking members 6 snap into the recess formed by joint members 5 through the entrance opening 24. The joint members 5 are resilient (the device is molded from resilient plastics material such as polypropylene) and thus yield as the shaft 23 is pressed through entrance opening 24 (which is smaller than the diameter of shaft 23) into the recess formed by joint member 5.

The cover member 3 is provided with an outwardly extending rim 9 extending all the way around cover member 3 and which merges with the grip tabs 4. The cover member 3 has an indentation, recess or depressed portion 10, which is directed into the interior or the cover member 3. The recess or depressed portion 10 is spanned by a strut or cross-member 11 on the outside that forms a top side carrying handle for the container. The recess or depressed portion 10 merges via a circumferential groove area 12 with the side wall 13 of the cover member 3. When the cover member 3 is used as a bowl, without the base member 1 being attached and with the recess or depressed portion 10 and handle 11 facing down to form the bottom of the "bowl", the "bowl" rests on the annular ring-like surface portion 25 (see FIG. 2) which forms a substantially-flat support surface portion when the cover member (3) is inverted to the "bowl" position. The internal groove 12 makes for simpler stirring or mixing of the contents of the bowl. When salads are being prepared, for example, the dressing can collect in the internal groove 12 and can thus be better mixed in with the salad. The outer surface of the groove 12 forms the annular substantially flat support surface 25.

Figure 2:
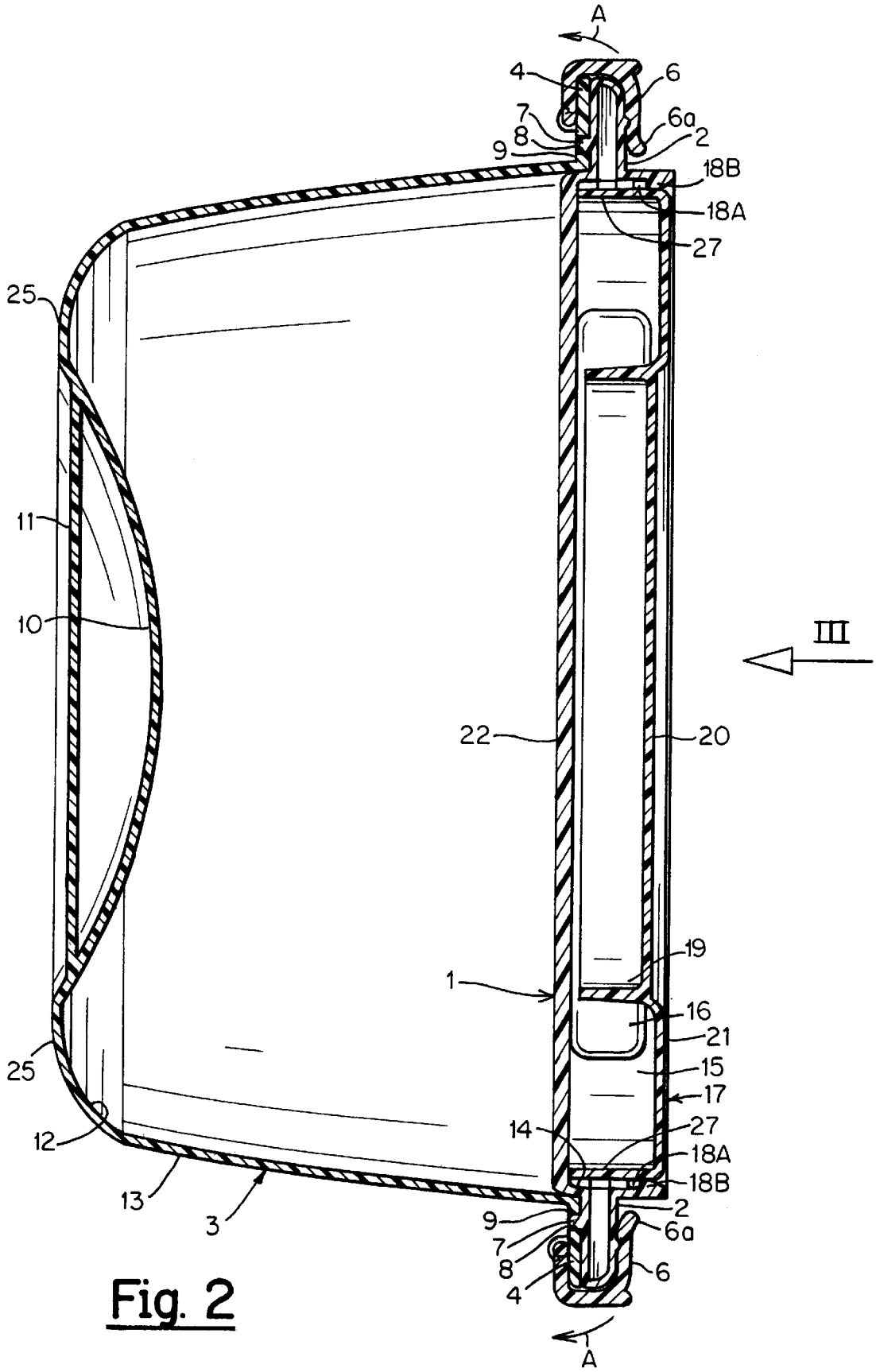
FIG. 2 is a section taken along the line II—II of FIG. 1.

The base member 1 is provided with an outwardly extending rim 14 extending all the way around, which merges with the grip tabs 2 and which holds the cover member 3 by positive engagement with the cover member 3, as seen in FIG. 2. The base member 1 is tublike toward the bottom (i.e., is hollow at the underside thereof) and thus forms a receptacle 15 below its food supporting surface 22 for holding temperature controlling elements, for example, chilling elements 16 such as ice packs or heating elements. Commercially available ice or cold packs which are chilled in an ordinary freezer can be used. Heating elements which are warmed in an oven or microwave oven can be alternatively used.

Figure 3:
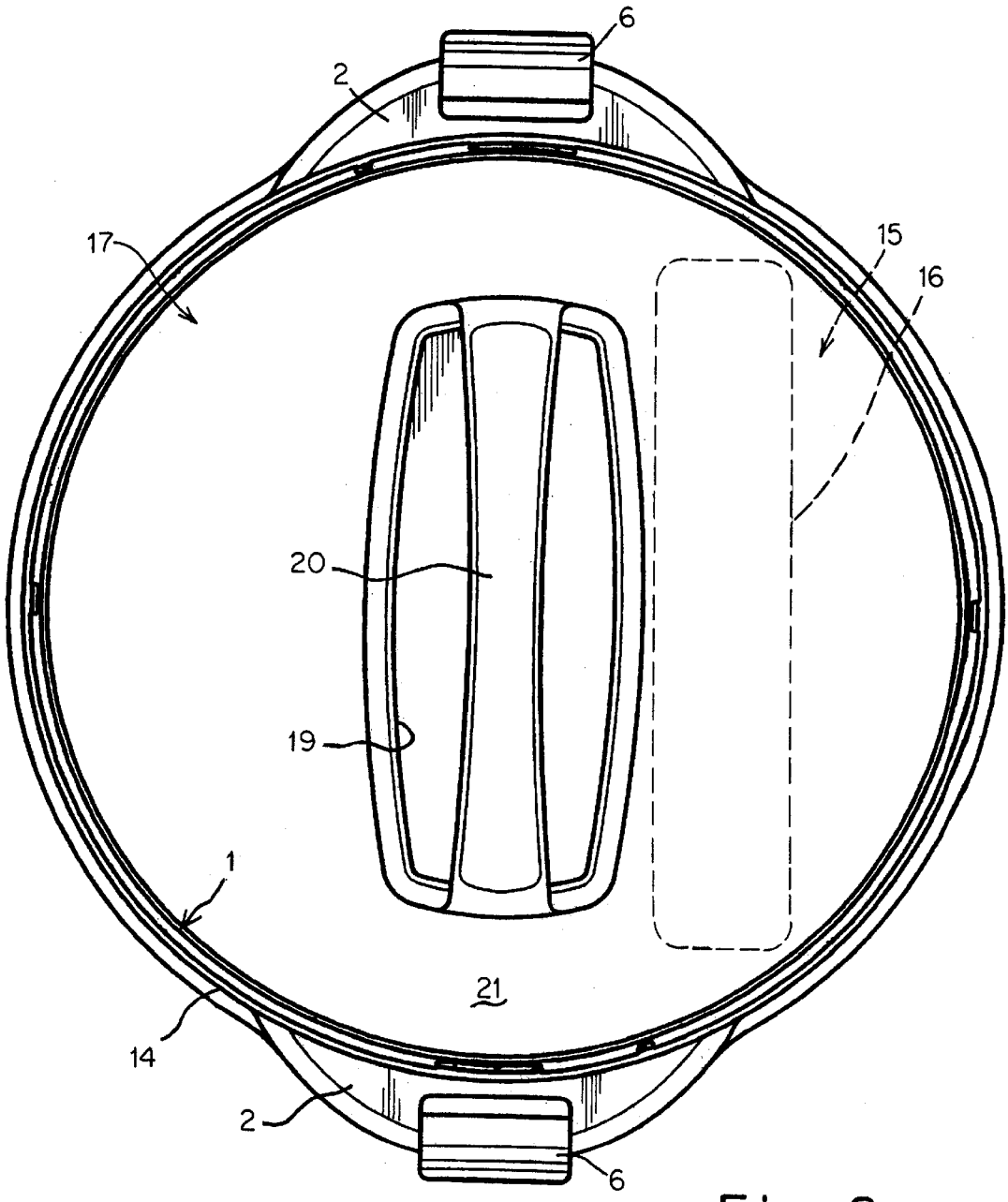
FIG. 3 is a bottom view looking in the direction of arrow III of FIG. 2.

The receptacle area 15 is closed by a lower lid or cover member 17 via bayonet-type locking or engagement elements 18A, 18B, as seen in FIG. 2. An elongated recess area 19 is formed in the lower lid 17 (see FIGS. 2 and 3), which is spanned by a second strut-type carrying handle 20. The bayonet-type locking elements 18A, 18B may be provided continuously around the periphery of the container, to provide a substantially liquid-proof seal in order to prevent condensation liquid from the temperature controlling elements 16 (especially from ice packs or chilling packs) from leaving the receptacle area 15. The upwardly projecting peripheral spacer ring 27 (see FIG. 2) of lid member 17 also serves to retain condensation inside the receptacle area 15. The height of the spacer ring 27 is at least as high as the depth of the recess of the handle 20. Alternatively, the bayonet-type locking elements 18A, 18B may be discrete locking elements placed spaced apart around the periphery of the container. The carrying handle 20 is formed in the recessed region 19 of the receptacle 15, thus creating a flat base area 21 for the base member 1 so that the base member 1 rests stably on a support surface such as a table or the like. Space for temperature controlling elements 16, such as cooling (chilling) or heating elements, is provided on each side of the carrying handle 20 or recess area 19, although FIG. 3 shows only one such temperature controlling element 16 by way of example. A second temperature controlling element 16 can be provided in the space to the left of recess area 19 as should be apparent from FIG. 3.

The container of the present invention is preferably molded from polypropylene. However, other suitable plastics materials could be used, as desired. The cover member 3 is preferably integrally molded as a single one-piece structure. The base member 1 is preferably made of two pieces, one piece being the upper member including the food support surface 22, and the second piece being the lid member 17. The pivotally mounted locking members 6 are separately molded and are assembled by snapping into the joint members 5. Thus, the container of the present invention can be manufactured in a relatively simple manner, and can be assembled in a relatively simple manner.

While the invention has been described above with respect to specific structure, features and implementations, it should be clear to those of ordinary skill in the art that various modifications could be made within the scope of the appended claims.

What is claimed is:

1. A container for holding foods, comprising:

a base member;

a cover member which is connected to the base member by releasable locking engagement;

a first carrying handle provided on a lower side of the base member; and a second carrying handle provided on an upper side of the cover member;

wherein to achieve a substantially flat support surface on both the base member and the cover member, the first carrying handle is integrated with and recessed into a contour of the base member such that a substantially flat bottom support surface is formed on the base member, and the second carrying handle is integrated with and recessed into a contour of the cover member such that a substantially flat top surface portion is formed on the cover member which serves as a support surface for the cover member when the cover member is inverted; and wherein said base member and said cover member are each provided with diametrically opposed grip tabs, and releasable locking members are provided for respectively connecting the grip tabs of said base member with the grip tabs of said cover member for releasable locking engagement in a vertical direction.

2. The container of claim 1, wherein said locking members are pivotally coupled to one of said base member and said cover member.

3. The container of claim 2, wherein said locking members are pivotally coupled to said cover member.

4. A container for holding foods, comprising:

a base member comprising a food supporting surface;

a cover member comprising: (i) means for being engaged with and releasably locked to the base member in a vertical direction so as to serve as a cover for the base member, and (ii) means for independently holding food when said cover member is inverted;

a first carrying handle provided on a lower side of the base member; and a second carrying handle provided on an upper side of the cover member;

wherein the first carrying handle is integrated with and recessed into a contour of the base member such that a substantially flat bottom support surface is formed on the base member;

wherein the cover member comprises a substantially central recess and the second carrying handle is integrated with and recessed into the substantially central recess of the cover member such that a substantially flat top surface portion is formed on the cover member which serves as a support surface for the cover member when the cover member is inverted; and wherein the base member comprises a lower receptacle, below the food supporting surface thereof, for holding at least one temperature controlling element.

5. The container of claim 4, wherein:

the base member comprises a first member defining said food supporting surface, and a bottom lid member for closing said lower receptacle, the at least one temperature controlling element is held in said lower receptacle by said bottom lid member, and said bottom lid member is provided with a locking device for connection by releasable engagement to said first member of said base member, for closing said lower receptacle.

6. The container of claim 5, wherein said bottom lid member is connected to said first member of said base member via a liquid-proof seal.

7. The container of claim 5, wherein:

said first carrying handle is disposed substantially centrally on said bottom lid member and is recessed into said lower receptacle, said bottom lid member includes an upwardly extending spacer ring molded around a peripheral portion of said bottom lid member in a peripheral region of said base member, and said spacer ring has at least a same height as said first carrying handle.

8. The container of claim 7, wherein said second carrying handle comprises a strut member spanning the substantially central recess of the cover member.

9. The container of claim 5, wherein said bottom lid member and said first carrying handle are integrally molded as a single one-piece structure.

10. The container of claim 9, wherein said cover member and said second carrying handle are molded as a single one-piece structure.

11. A container for holding foods, comprising:

a base member comprising a food supporting surface;

a cover member comprising: (i) means for being engaged with and releasably locked to the base member in a vertical direction so as to serve as a cover for the base member, and (ii) means for independently holding food when said cover member is inverted;

a first carrying handle provided on a lower side of the base member; and a second carrying handle provided on an upper side of the cover member;

wherein the first carrying handle is integrated with and recessed into a contour of the base member such that a substantially flat bottom support surface is formed on the base member;

wherein the cover member comprises a substantially central recess and the second carrying handle is integrated with and recessed into the substantially central recess of the cover member such that a substantially flat top surface portion is formed on the cover member which serves as a support surface for the cover member when the cover member is inverted;

wherein said second carrying handle comprises a strut member spanning the substantially central recess of the cover member;

wherein a transitional region is provided between a side wall of said cover member and said substantially central recess; and wherein said substantially central recess ends at a groove portion one side of which forms said transitional region and the other side of which forms said substantially flat top surface portion.

12. The container of claim 11, wherein said cover member and said second carrying handle are molded as a single one-piece structure.

* * * * *